US005551883A

United States Patent [19]

Davis

[11] Patent Number: 5,551,883

[45] Date of Patent: Sep. 3, 1996

[54] ELECTRICAL CONNECTOR

[75] Inventor: Wayne S. Davis, Harrisburg, Pa.

[73] Assignee: The Whitaker Corporation, Wilmington, Del.

[21] Appl. No.: 358,271

[22] Filed: Dec. 19, 1994

Related U.S. Application Data

[63] Continuation-in-part of Ser. No. 153,700, Nov. 17, 1993, abandoned.

[51] Int. Cl.[6] ..... H01R 13/432; H01R 13/41; H01R 23/68

[52] U.S. Cl. ..... 439/65; 439/83; 439/636; 439/638; 439/816

[58] Field of Search ..... 439/65, 638, 636, 439/816, 83

[56] References Cited

U.S. PATENT DOCUMENTS

| | | | |
|---|---|---|---|
| 4,457,570 | 7/1984 | Bogese, II | 339/17 C |
| 4,632,475 | 12/1986 | Tomita | 339/4 |
| 4,715,819 | 12/1987 | Iwasa et al. | 439/31 |
| 4,865,553 | 9/1989 | Tanigawa et al. | 439/31 |
| 4,907,987 | 3/1990 | Douty et al. | 439/571 |
| 4,975,062 | 12/1990 | Evans et al. | 439/13 |
| 5,004,434 | 4/1991 | Aiello et al. | 439/636 |
| 5,176,526 | 1/1993 | Hillbish et al. | 439/108 |

FOREIGN PATENT DOCUMENTS

| | | | |
|---|---|---|---|
| 0353421 | 8/1989 | European Pat. Off. | H01R 23/70 |

*Primary Examiner*—Kenneth J. Ramsey
*Attorney, Agent, or Firm*—Anton P. Ness

[57] ABSTRACT

An electrical connector, comprising: an insulating housing 2, a contact receiving cavity 3 in the housing 2, an electrical contact 4 in a first cavity portion 5 of the cavity 3 for connection to a mating electrical contact 7 of another, mating electrical connector 8, a contact portion 15 of the contact 4 extending along the cavity 3, a tip 17 of the contact portion 15 received in a first channel 24 of the cavity 3, and the contact portion 15 projecting into a second cavity portion 6 of the cavity 3, the second cavity portion 6 being open along two intersecting sides 9, 10 of the housing 2 for connection to a mating electrical contact 7 of another, mating electrical connector 8.

14 Claims, 10 Drawing Sheets

ELECTRICAL CONNECTOR

This application is a continuation in part of application Ser. No. 08/153,700, filed Nov. 17, 1993, abandoned.

FIELD OF THE INVENTION

The invention relates to an electrical connector for a package that is accessible along two intersecting sides for receiving a mating electrical contact of another, mating electrical connector.

BACKGROUND OF THE INVENTION

For example, an electrical connector for a package is disclosed in U.S. application Ser. No. 08/035,817, filed Mar. 23, 1993, wherein the package is suitable for containing an electrical device in the form of battery cells. The battery cells are merely exemplary of electrical devices of many varieties and kinds that could be contained in the package, and that utilize terminals protected by the package. An electrical connector for a package includes one or more electrical contacts that are accessible through an end and a side of an insulating package, with the package protecting the contacts. The package is adaptable for containing various kinds of electrical devices that utilize the contacts for electrical connection to another, mating electrical connector, such as a header mounted to a circuit board.

According to U.S. patent application Ser. No. 08/105,987, filed Aug. 10, 1993, an electrical connector for a package is adapted for upside down, or top side up, mating connection with another, mating electrical connector.

SUMMARY OF THE INVENTION

According to a feature of the invention, an electrical connector for a package for an electrical device comprises an insulating housing containing an electrical contact, wherein the contact comprises, a contact portion for connection to a mating electrical contact of another, mating electrical connector, and a tip of the contact portion being tucked inside a channel in an insulating housing that covers the tip to protect the tip from damage. This feature provides protection for the contact portion to such an extent, that the entirety of the electrical contact can be manufactured in a small and inherently fragile size. For example, in one, alternative embodiment, the electrical contact comprises a thin blade, with the contact portion projecting outwardly of a thickness plane of the blade to engage a mating electrical contact of another, mating electrical connector, and with a tip of the contact portion being received in a channel of the insulating housing.

According to the invention, an electrical connector comprises, an insulating housing, a cavity in the housing having a contact receiving first cavity portion and a second cavity portion for receiving a mating electrical contact of another, mating electrical connector, an electrical contact in the first cavity portion, a contact portion on the electrical contact projecting along the second cavity portion for connection to a mating electrical contact of another mating electrical connector received in the second cavity portion, and a tip of the contact portion being received behind a shoulder in a channel of the first cavity portion.

The invention will now be described by way of example with reference to the drawings, according to which:

DETAILED DESCRIPTION

Figure 1:
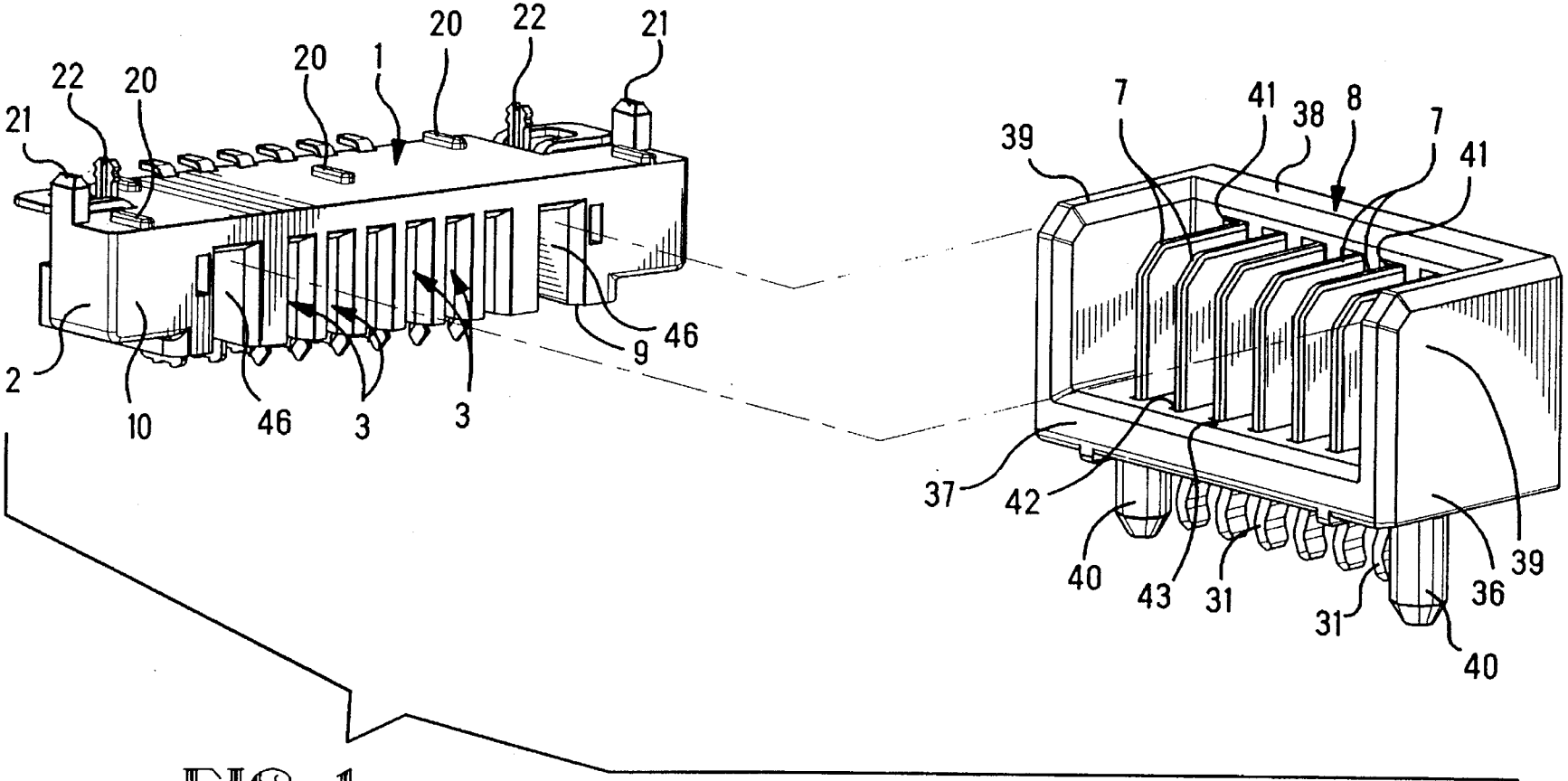
FIG. 1 is an isometric view of a connector and another, mating connector.
Figure 2:
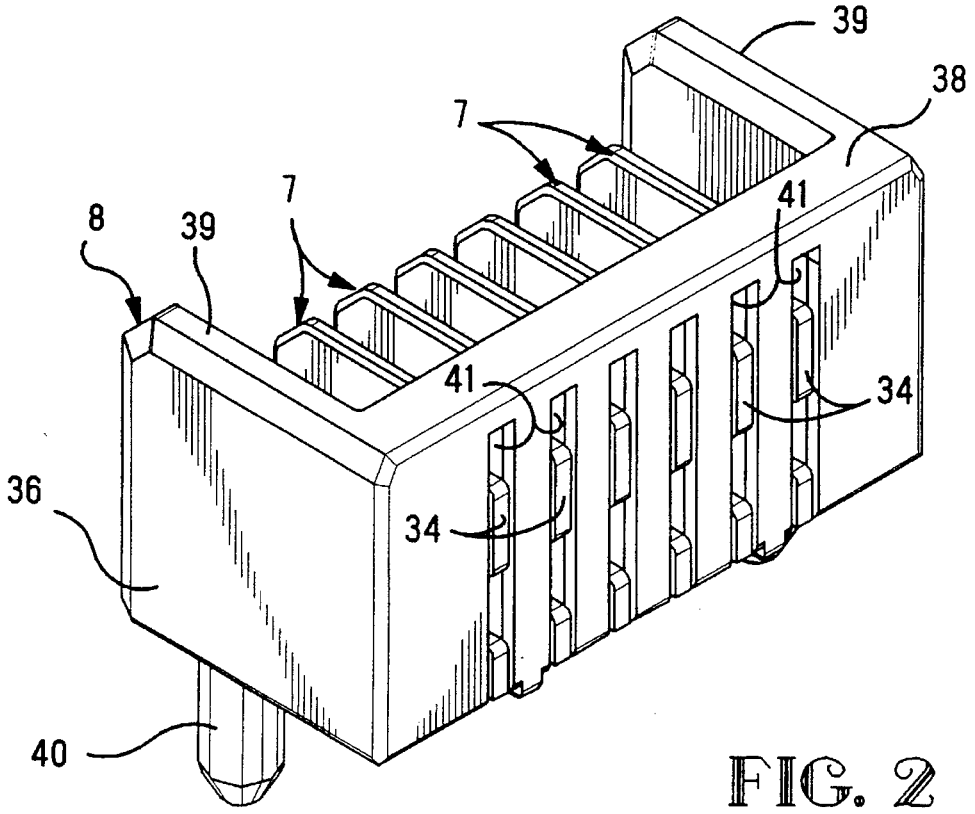
FIG. 2 is an isometric view of a rear side of the mating connector shown in FIG. 1.

With reference to FIGS. 1, 6, 7, 9–11 and 12–15, an electrical connector comprises an insulating housing 2, at least one cavity 3 in the housing 2, and an electrical contact 4 in each cavity 3. Each cavity comprises, a first cavity portion 5 for receiving the contact 4 and a second cavity portion 6 for receiving another, mating contact 7, FIG. 1, of a mating connector 8. The second cavity portion 6 communicates with the first cavity portion 5 and is open along a bottom side 9 and a front side 10, comprising two intersecting sides of the housing 2 for receiving the mating contact 7.

For example, the housing 2 is adapted to be connected to a circuit board of an electrical device, not shown. Further, for example, each electrical contact 4 comprises an electrical terminal for such an electrical device.

Figure 8:
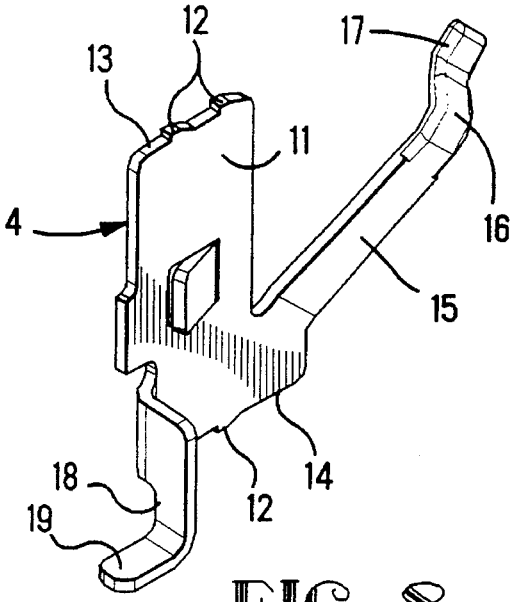
FIG. 8 is an isometric view of an electrical contact of the connector shown in FIG. 1.
Figure 9:
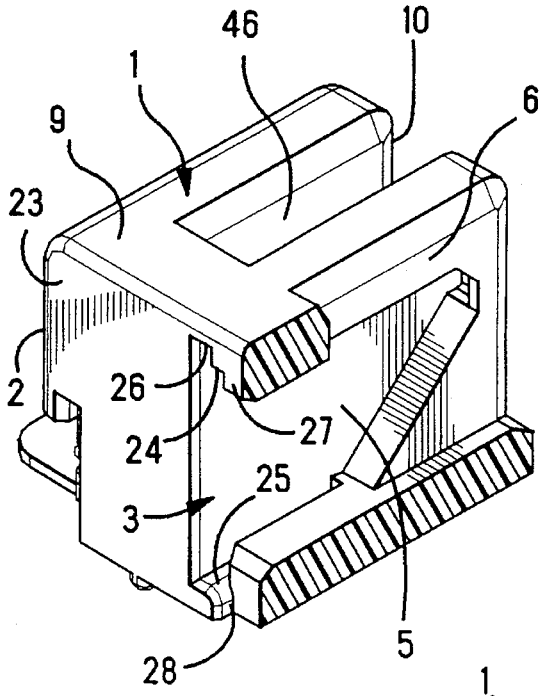
FIG. 9 is a fragmentary isometric view of the connector shown in FIG. 7, shown partially broken away as depicted along the line 9—9 of FIG. 7.
Figure 12:
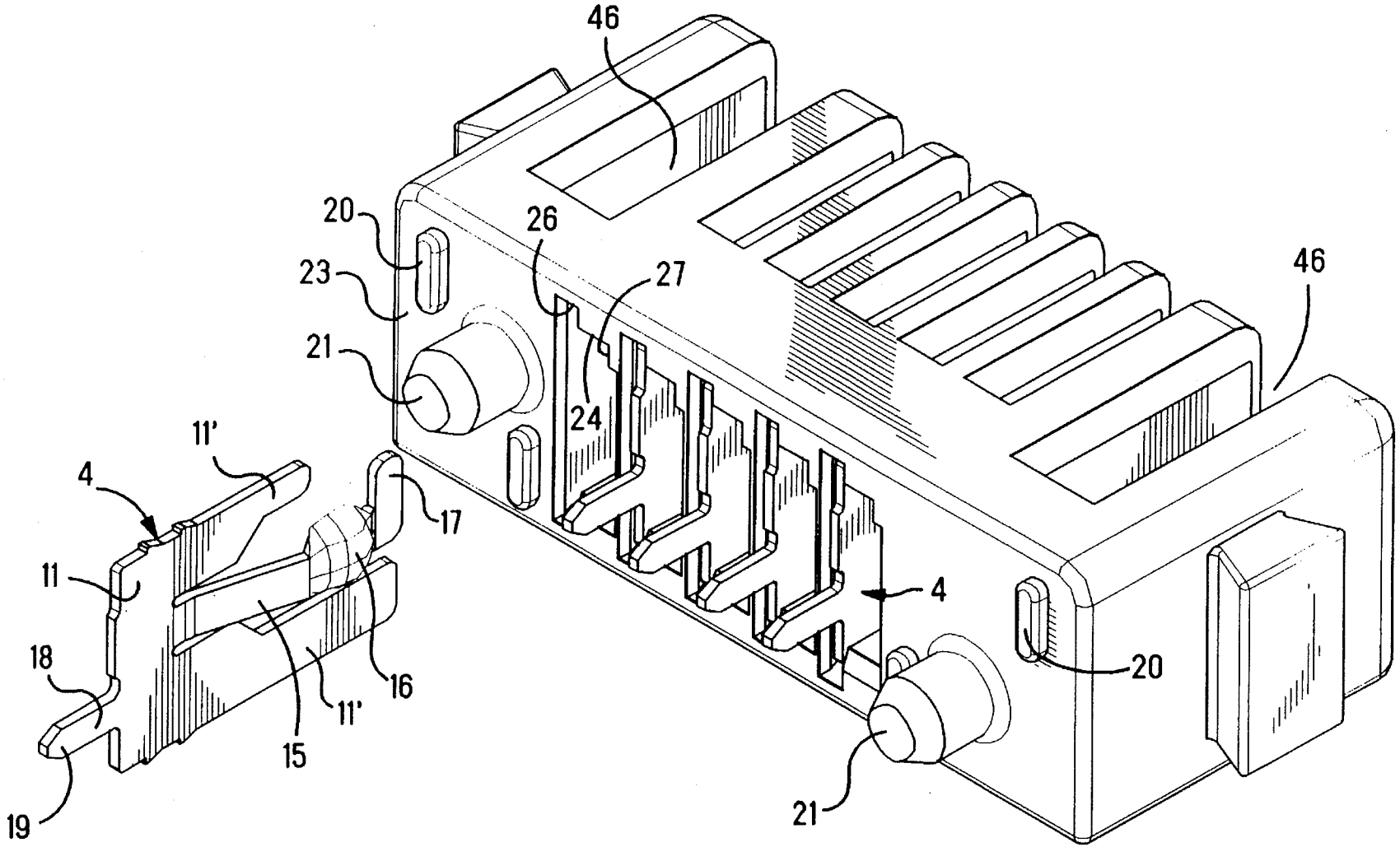
FIG. 12 is a perspective view of a connector of alternate construction with parts separated from one another.
Figure 13:
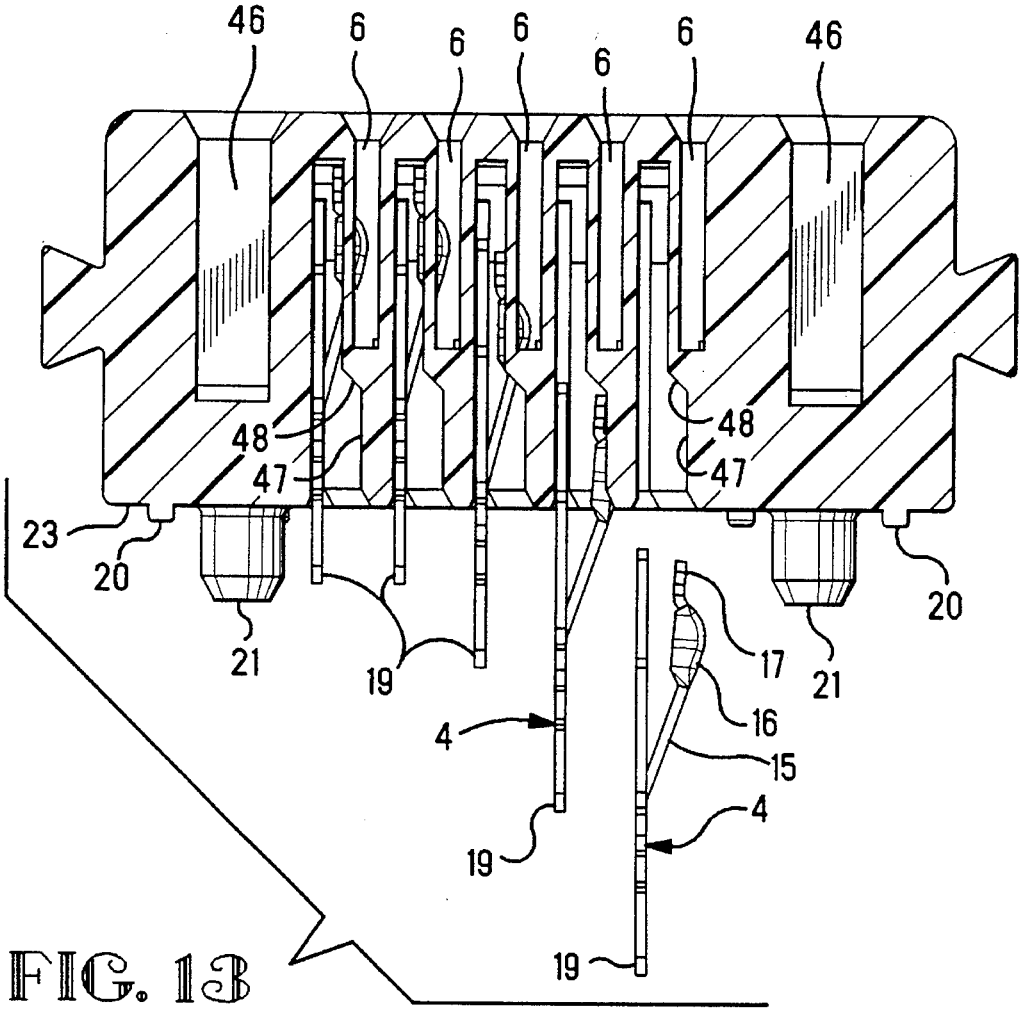
FIG. 13 is a top view of the connector shown in FIG. 12 with parts separated from one another.
Figure 15:
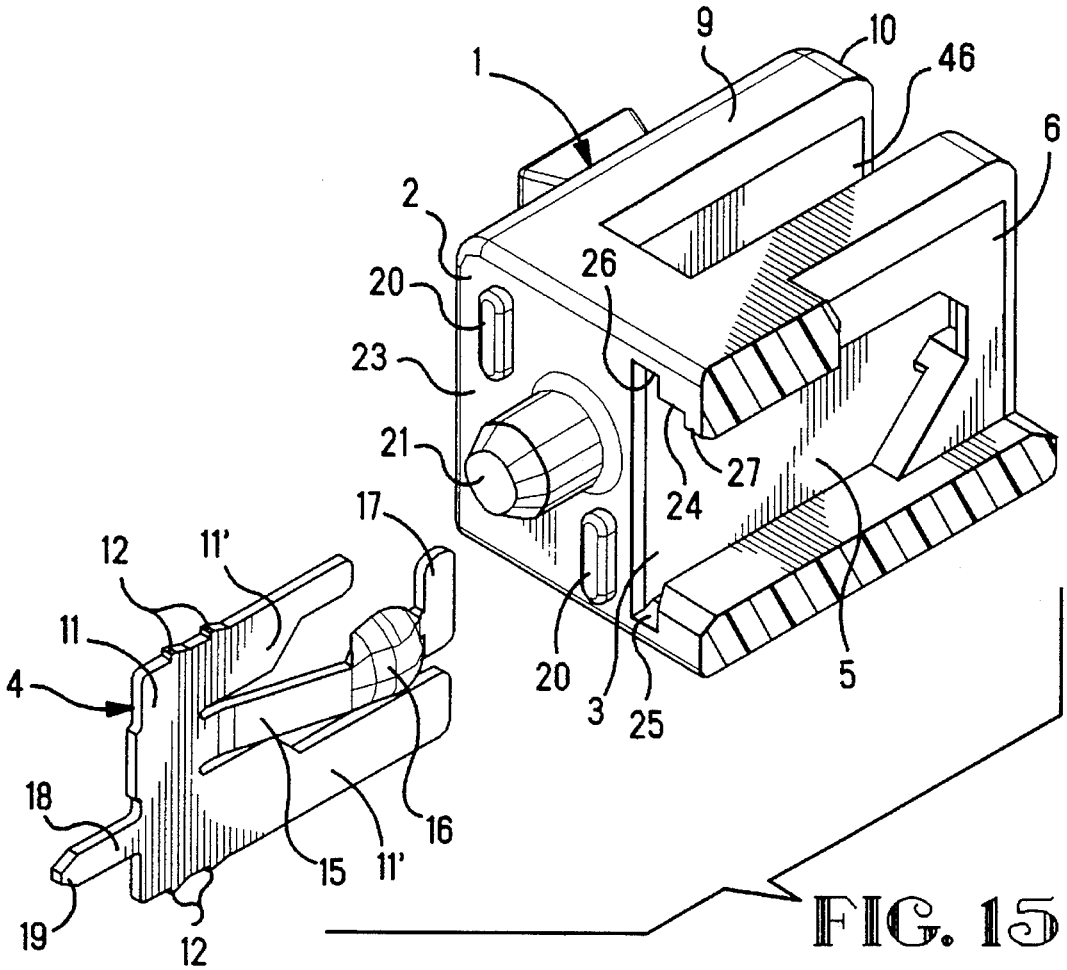
FIG. 15 is a fragmentary isometric view of the connector shown in FIG. 12, shown partially broken away and with an electrical contact.

With reference to FIGS. 8 and 15, one said contact 4 will be described. Contact 4 is of unitary construction, stamped and formed from a strip or blank of thin metal and has a thickness plane defined by the blank. In each embodiment, the contact 4 comprises, in part, a thin blade 11 extending in the plane of thickness. Barbs 12 project from respective top and bottom edges 13, 14 of the blade 11. A contact portion 15 extends forwardly in FIGS. 1, 8, 12 and 15, and diagonally in FIGS. 1 and 8, from a front edge of the blade 11, and provides a cantilever resilient spring. In FIGS. 12 and 15, the contact portion 15 is flanked on opposite sides by respective fingers 11' projecting forward of the unitary blade 11. The diagonal length provides a longer cantilever spring than would a length extending straight forward. The contact portion 15 is bowed along its length and has an obversely curved contact surface 16 adjacent to a reversely bent tip 17. At a rear of the contact 4, on the blade 11, is an electrical terminal 18 pointing downward. In FIG. 8, the terminal 18 is elbow shaped. In FIG. 15, the terminal 18 is a post for plugging into an aperture of a circuit board, not shown. The terminal 17 in FIG. 8 is bent outwardly from the plane of thickness of the blade 11. A foot 19 of the terminal 18 is bent to provide a surface mount terminal that is adapted to mount flatly to a surface of a circuit board by a solder joint, not shown. Alternatively, the foot 19can remain unbent, in FIG. 15, to provide a post for mounting in an aperture of a circuit board, not shown.

The housing 2 of the embodiments of the connector 1 will now be described with reference to FIGS. 6–11, and 12–16. The housing 2 is shown inverted in FIGS. 6, 7 and 9–11. Projecting feet 20 are on a rear side 23 of the housing 2 to elevate the side 23 from a surface of a circuit board, not shown. Projecting posts 21 on the side 23 are adapted to,extend through openings in a circuit board, not shown. Metal board locks 22 are mounted onto the housing 2 of FIGS. 6–11, and project from the bottom side 9 of the housing 2. Further details of the board locks 22 are disclosed in U.S. application Ser. No. 07/850733 Filed Mar. 13, 1992 (abandoned).

The first cavity portion 5 of each cavity 3 projects forwardly from the rear side 23, FIGS. 7, 9, 10, and 12–15 of the housing 2. With reference to FIGS. 7, 9–11, 12, 15 and 16, along top and bottom edges of the first cavity portion 5, a first channel 24 and a second channel 25 are aligned with each other. The first channel 24 has a stepped width defining a groove 26 and a shoulder 27. Both channels 24, 25 are slightly wider than the thickness plane of the contact 4, to receive edgewise the top and bottom edges 13, 14 of the blade 11. The opposite edges 13, 14 of the blade 11 are moved forwardly along the respective channels 24, 25 until the elbow shaped, electrical terminal 18 registers in a recess 28, FIGS. 9 and 10, in the rear side 23 and the bottom side 9 of the housing 2. The barbs 12 on the blade 11 embed in bottoms of respective channels 24, 25 to resist relative movement of the blade 11 and the housing 2.

With reference to FIGS. 9, 10, 12 and 14–16, the width of the first channel 24 is stepped to receive both the width of the blade 11 (together with the width of the fingers 11') and the tip 17 of the contact portion 15. Both the blade 11 with the fingers 11' and the tip 17 of the contact portion 15 are moved forwardly along the first channel 24. The tip 17 of the contact portion 15 remains within the first channel 24 behind the shoulder 27, and is protected from being struck by the mating contact 7 to be received in the second cavity portion 6.

Figure 10:
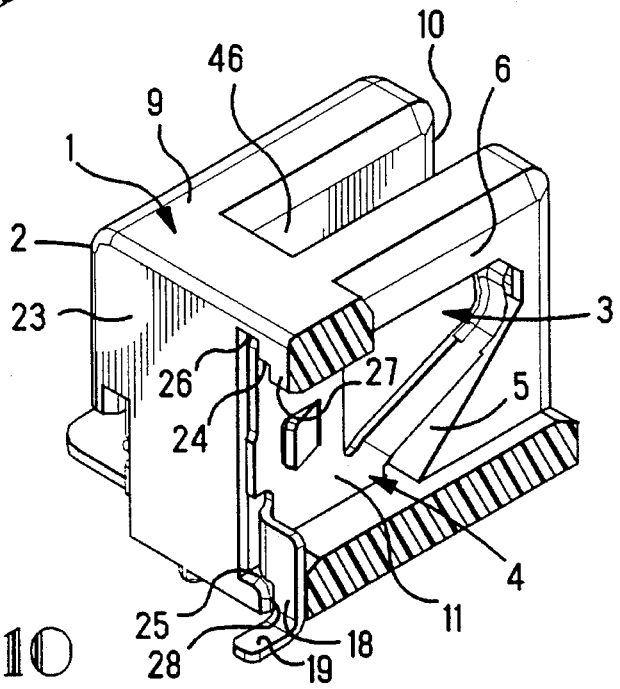
FIG. 10 is a view similar to FIG. 9, illustrating an installed contact according to FIG. 8.
Figure 11:
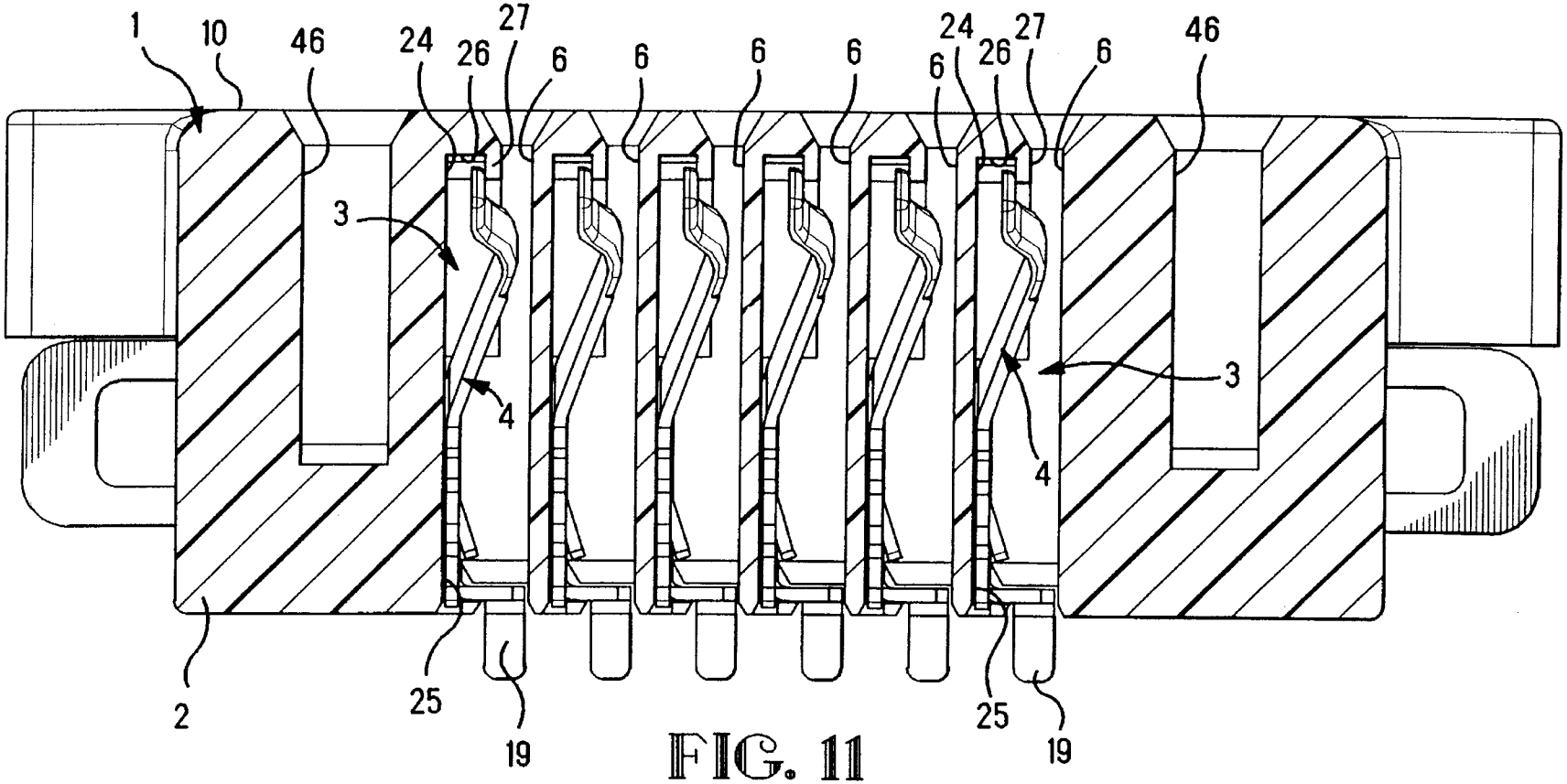
FIG. 11 is a rear side view of the connector shown in FIG. 6, partially broken away to illustrate further details.
Figure 16:
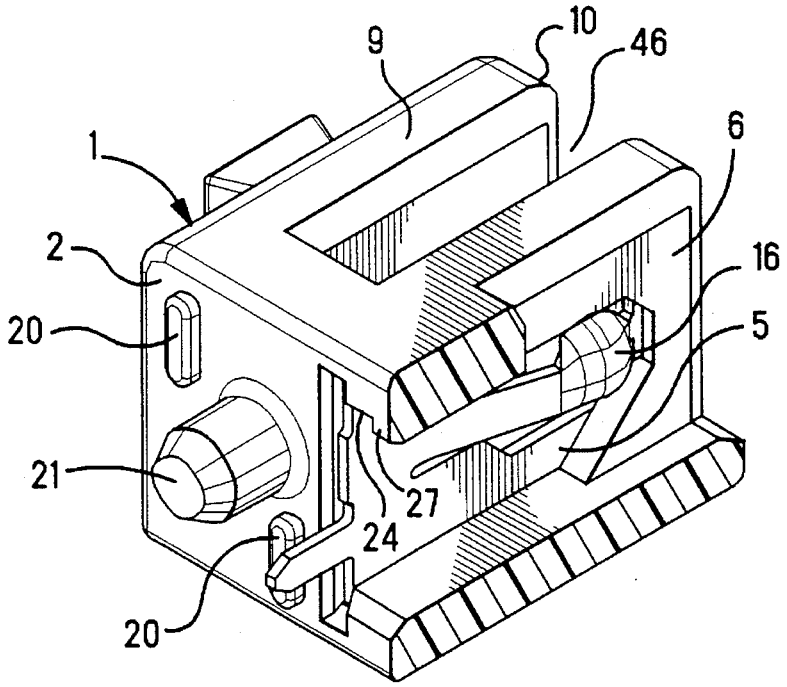
FIG. 16 is a view similar to FIG. 9, illustrating an installed contact.

With reference to FIGS. 10 and 16, the contact portion 15 extends forwardly of the blade 11 to occupy a front portion of the cavity 3 that is unoccupied by the blade 11. The contact portion 15 extends forward with respect to the blade 11 and forward with respect to the cavity 3. Thereby, for the contact portion 15 of FIGS. 8–10, the spring length, along a diagonal direction, is desirably longer than a spring length that would extend straight forward. The contact portion 15 is bowed to project laterally outward from a plane of thickness of the blade 11 and to project, at least partially, into the second cavity portion 6.

Figure 14:
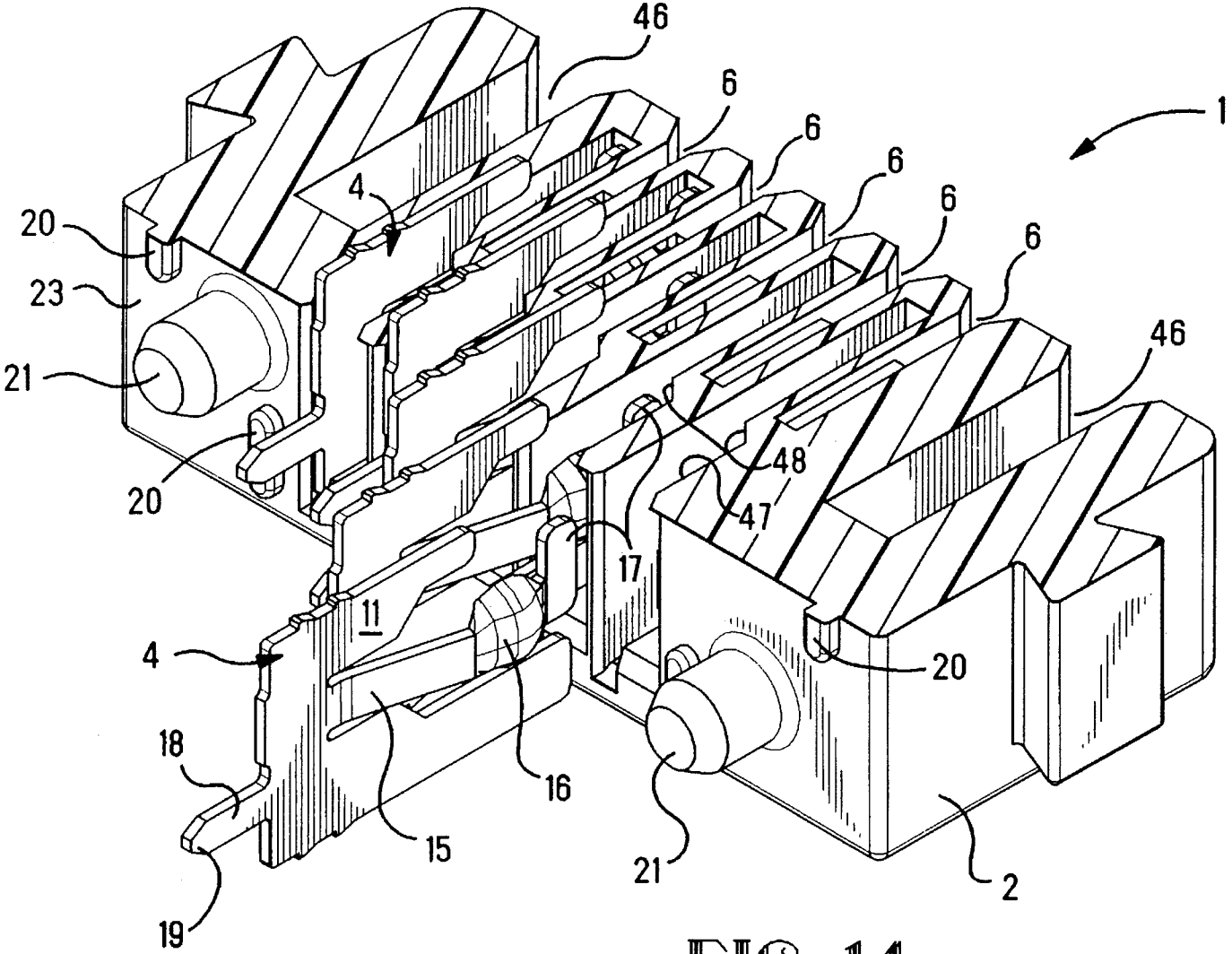
FIG. 14 is a perspective view of a portion of the connector shown in FIG. 12, with parts cut away.

With reference to FIGS. 12 and 14, each contact surface 16 is spoon shaped. The tip 17 of each contact 4 traverses along the shoulder 27 as the contact 4 is inserted along a corresponding cavity 3. As shown in FIG. 14, an interior converging surface 47 extends along an interior of the cavity 3, and that is tapered laterally at a taper 48 to narrow the cavity portion 24.

The fingers 11' impinge the interior of the cavity 3 before and during further movement of the tip 17 along with the cavity 3. The tip 17 traverses along the surface 47 and is deflected resiliently by the surface 47 to apply a spring bias called a preload, to the contact portion 15. The contact surface 16 will protrude into the cavity portion 6 to engage a corresponding mating contact 7 of the mating connector 8. The spring bias will be applied to bias the contact surface 16 against the mating contact 7 to assure frictional engagement.

Figure 3:
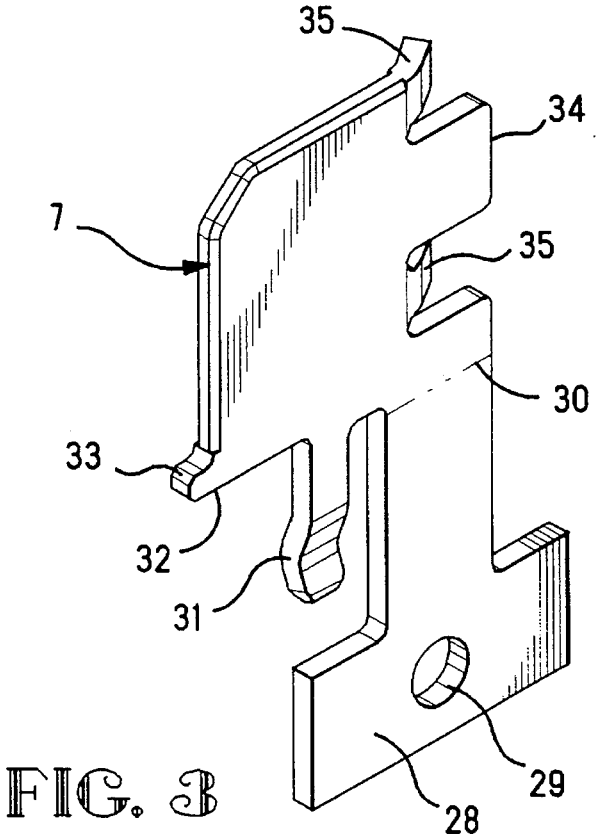
FIG. 3 is an isometric view of an electrical contact of the mating connector shown in FIG. 1.
Figure 4:
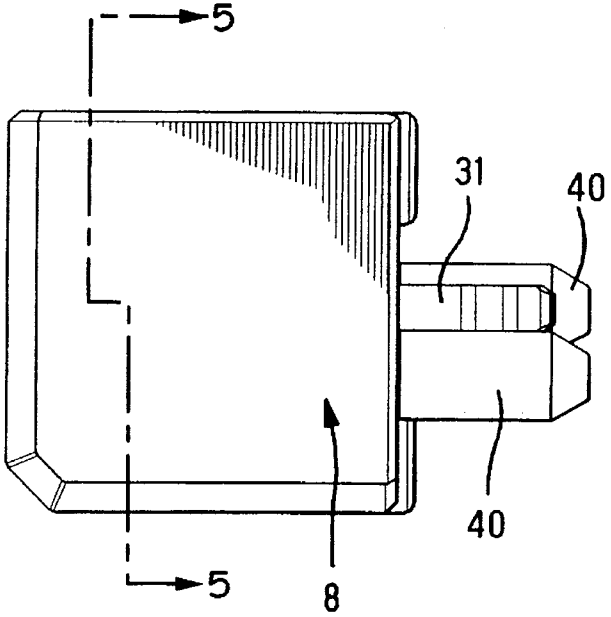
FIG. 4 an end view of the connector shown in FIG. 1.

With reference to FIG. 3, each mating contact 7 will be described. Each mating contact 7 is of unitary construction, stamped and formed from a metal strip. Initially, the mating contact 7 is joined with a carrier strip 28, shown with a pilot hole 29. Subsequently the mating contact 7 is separated from the carrier strip 28 along the dotted line 30. Each mating contact 7 comprises a thin blade, with a width defined by a plane of thickness of the blade. An electrical terminal 31 extends from a lower edge 32 of the blade for connection to a circuit board, not shown. For example, the terminal 31 in the form of an elongated post is adapted for mounting in an aperture of circuit board. The terminal 31 can have other forms, for example, a form adapted as a known, surface mount terminal, not shown, that is adapted to mount to a conductive pad on a surface of a circuit board by a solder joint, not shown.

Each mating contact 7 is constructed with a front projecting finger 33 along the lower edge 32, and a rear portion 34 from which a pair of locking flanges 3B extend rearwardly, the flanges 35 being bent to project diagonally outward from the thickness plane.

With reference to FIGS. 1, 2, 4 and 5, the mating connector 8 further comprises a unitary one piece, insulating housing block 36, which comprises, a base 37 for mounting on another circuit board not shown a side wall 38 extending from the base 37, and projecting end barriers 39 extending outward with respect to the side wall 38 and extending upward with respect to the base 37. The base 37 is mounted to a circuit board by fasteners, for example, posts 40 depending from the base 37.

At least one cavity 41 in the side wall 38 is adapted to receive a respective mating contact 7 that is inserted into the cavity 41 from a rear of the housing block 36. Each cavity 41 is slotted with a width only slightly wider than the thickness plane of the mating contact 7, So as to receive and to interfit with the edgewise width of the mating contact 7. Each cavity 41 extends from the rear of the housing block 36 and forwardly through the sidewall 38, and forwardly along the base 37. The terminal 31 of such mating contact 7 projects from the cavity 41 through a bottom of the base 37 for connection to a circuit board, not shown. For example, the terminal 31 is an elongated post adapted for mounting in an aperture of a circuit board. The terminal 31 is moved forwardly along the cavity 41 together with the remainder of the mating contact 7 until a front wall 42 of the cavity 41 resists further forward movement of the terminal 31 relative to the base 37. A front of the cavity 41 extends under the front wall 42 and beneath a ledge 43, FIGS. 1 and 5, along a front of the base 37. The finger 33 of the contact 7 is moved along the cavity 41 together with the remainder of the contact 7, until the finger 41 registers under the ledge 43 to resist upward movement of the contact 7 relative to the base 37.

Figure 5:
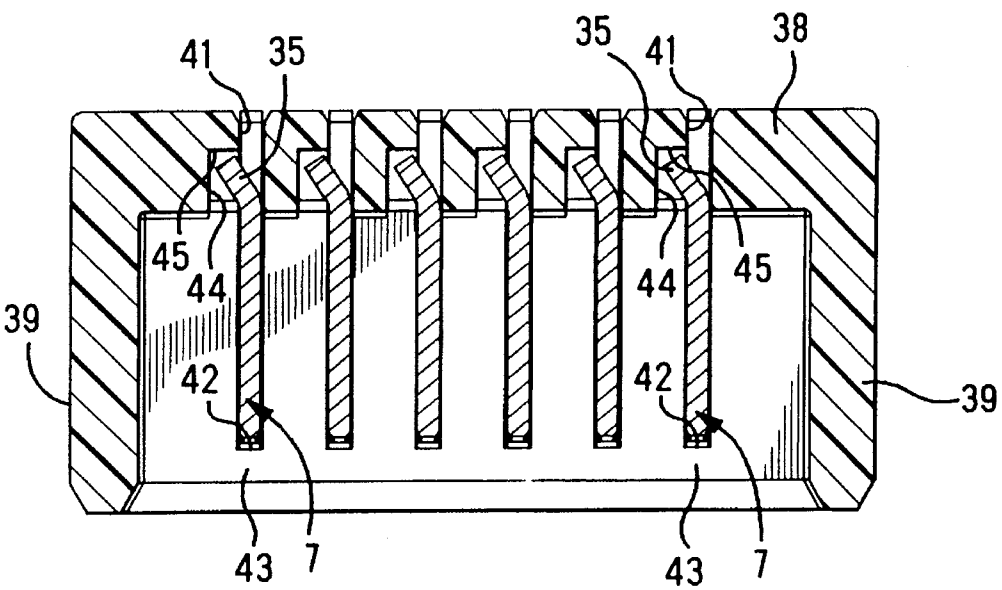
FIG. 5 is a section view taken along the line 5—5 of FIG. 4.
Figure 6:
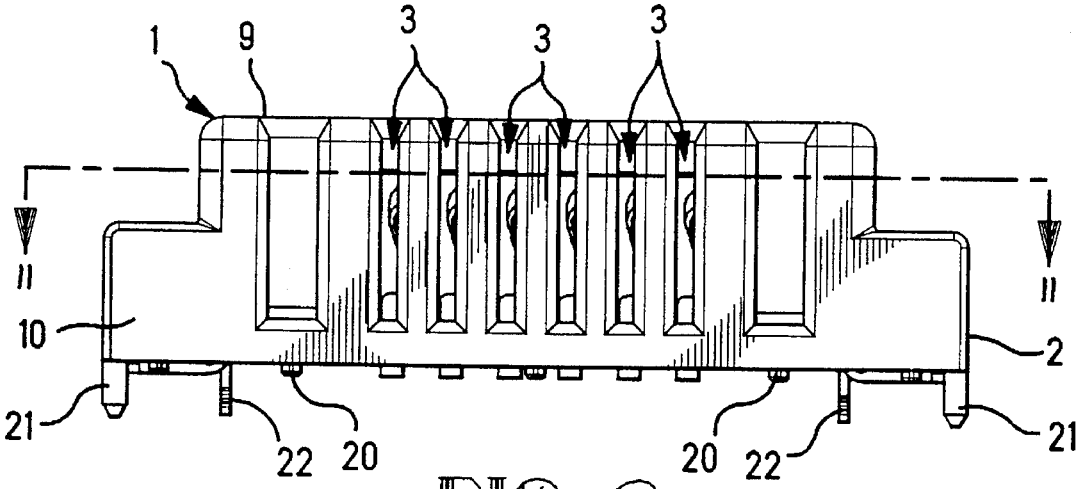
FIG. 6 is a front side view of the connector shown in FIG. 1.
Figure 7:
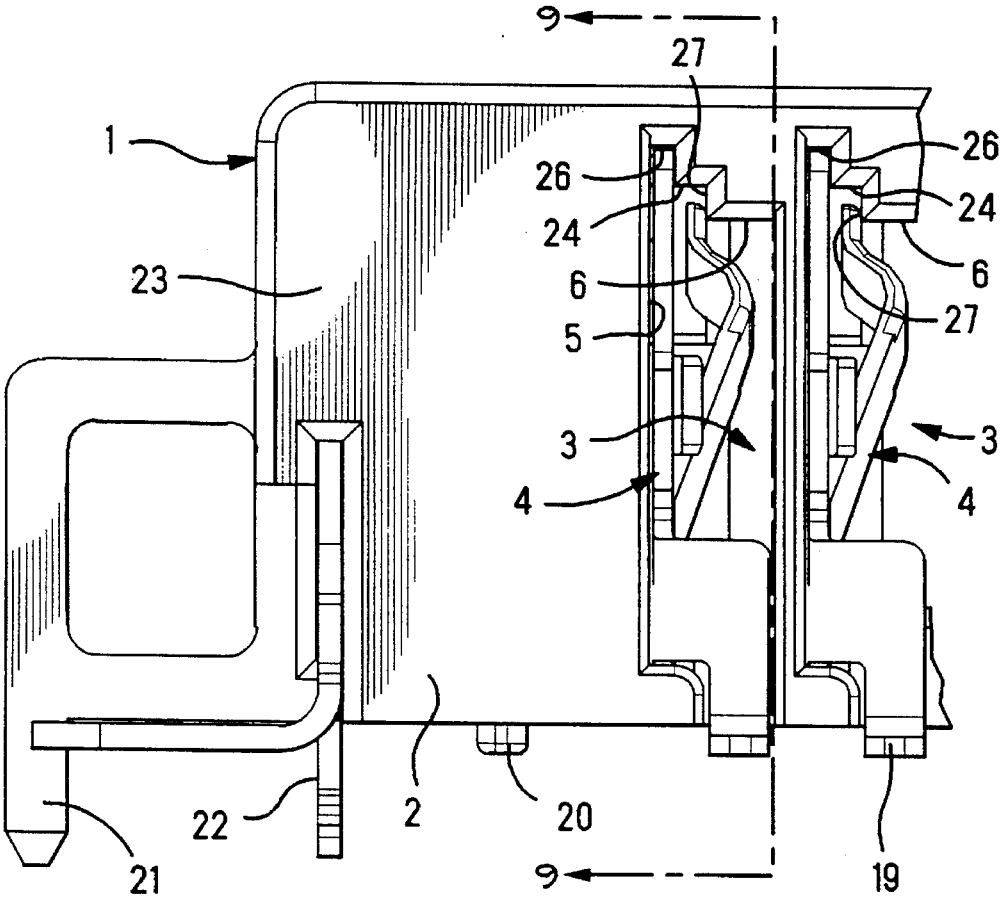
FIG. 7 is a fragmentary rear side view of the connector shown in FIG. 1.

Each of the locking flanges 35, FIG. 5, must deflect resiliently into the thickness plane of the mating contact 7 to enter into the cavity 41. After entering the cavity 41, each of the locking flanges 35 springs resiliently outward of the thickness plane to register in a recess 44, FIG. 5, that is a portion of the cavity 41. The locking flanges 35 face a front facing wall 45 in the recess 44 to resist rearward movement of the mating contact 7 relative to the base 37.

Each contact 7 extends from the base 37 of the housing block 36 toward the open top of the housing block 36, and toward the open side of the housing block 36. Each contact 7 is accessible through both the open top and the open side of the housing block 36 for connection to a contact 4 of the connector 1. The end barriers 39 are at opposite ends of a row comprised of each mating contact 7. The barriers 39 are at least slightly taller than each mating contact 7 to protect the mating contact 7 from being struck accidentally. The sizes and spacing of the barriers 39 are adapted for matching with the sizes and spacing of recesses 46, FIGS. 1 and 11, in the side 10 of the housing 2 of each connector 1. The barriers 39 have different widths for coupling by insertion into the recesses 46 of matching different widths, that are in the front side 10 of the housing 2. The barriers 39 would be unable to couple with recesses 39 of incompatibly different sizes and spacing comprising, for example, those on a different, incompatible housing 1. Further, the recesses 46 of different widths may vary to distinguish different connectors 1. The connector 1 can couple or uncouple from the mating connector by relative motion involving movement of the front side 10 into the open side of the mating connector 8, or by relative motion involving movement of the bottom side 9 into the open top of the mating connector 8. Pivotal motion can accompany the described relative motion of the connector 1, even while the respective contacts 4, 7 of the connectors 1, 8 are engaged.

Figure 17:
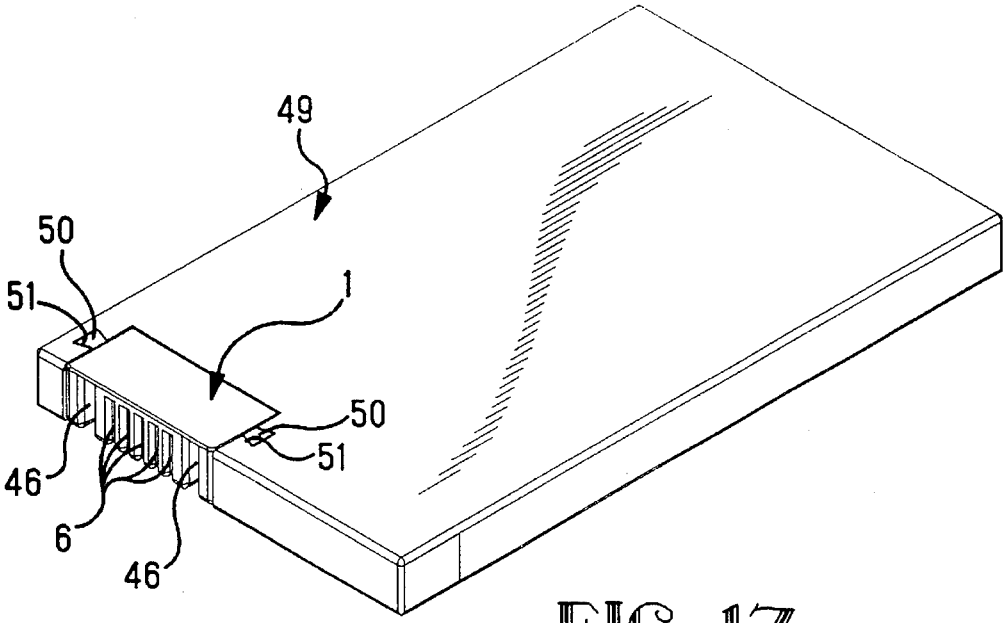
FIG. 17 is an isometric view of a battery incorporating the connector as shown in FIG. 12.

FIG. 17 illustrates a package 49 for a rechargeable battery that comprises battery cells, connected to a circuit board all inside the package (not shown). The posts 9 of the contacts 4 are connected to the same circuit board as is the battery cells, such that the connector 1, of FIGS. 12–16, becomes incorporated with the battery and the package 49. Further details of the package are disclosed in U.S. patent application Ser. No. 08/035,817 filed Mar. 23, 1993, abandoned. The connector 1 is provided with unitary interlocks 50 in the shape of dovetail tongues that fit into mating interlocks 51 in the form of dovetail grooves in the package 49.

I claim:

1. An electrical connector, comprising:

an insulated housing, at least one contact receiving cavity in the housing, an electrical contact in a first cavity portion of the cavity, a contact portion of the contact extending into a second cavity portion of the cavity to engage a mating contact received in the second cavity portion, and a tip of the electrical contact is received in a channel of the first cavity portion, and said contact portion extends diagonally forward in the first cavity portion.

2. An electrical connector as recited in claim 1, wherein the second cavity portion is open along two intersecting sides of the housing to receive the mating contact.

3. An electrical connector as recited in claim 1, wherein edges of the contact are received along respective channels of the first cavity portion.

4. An electrical connector as recited in claim 1, wherein the electrical contact comprises a blade, with the contact portion extending forwardly of the blade.

5. An electrical connector as recited in claim 4, wherein the contact portion comprises a cantilever contact finger.

6. An electrical connector as recited in claim 4, wherein the blade is received edgewise in the first cavity portion.

7. An electrical connector as recited in claim 4, wherein the contact portion bows to project into the second cavity portion, and a tip of the contact portion is received behind a shoulder of the first cavity portion.

8. An electrical connector as recited in claim 4, wherein an edge of the blade and a tip of the contact portion are received in a stepped channel of the first cavity portion.

9. An electrical connector as recited in claim 4, wherein a tip of the contact portion is bowed outwardly from the thickness plane of the blade to extend into the second cavity portion, and the tip of the contact portion is received in a channel of the first cavity portion.

10. An electrical connector, comprising:

an insulating housing, a contact receiving cavity in the housing, an electrical contact in a first cavity portion of the cavity for connection to another, mating electrical connector, a contact portion of the contact extending along the cavity, a tip of the contact portion received in a first channel of the cavity, and the contact portion projecting into a second cavity portion of the cavity, the second cavity portion being open along two intersecting sides of the housing for connection to a mating electrical contact of the mating electrical connector, and the tip is resiliently deflected by a surface within the cavity, while fingers flank the tip and the fingers are supported against an interior of the cavity.

11. An electrical connector as recited in claim 10, wherein edges of the contact are fitted in the channels.

12. An electrical connector as recited in claim 10, wherein a blade on the contact extends along the cavity, and the contact portion extends from the blade.

13. An electrical connector as recited in claim 12, wherein the contact portion is bowed to project laterally outward from a plane of thickness of the blade.

14. An electrical connector as recited in claim 12, wherein the first cavity portion is slotted and receives the blade edgewise, the second cavity portion is offset from the first cavity portion, a section of the first cavity portion communicates with the second cavity portion, the contact portion extends into the section of the first cavity portion.

* * * * *